US008852521B2

(12) United States Patent
Todd et al.

(10) Patent No.: US 8,852,521 B2
(45) Date of Patent: Oct. 7, 2014

(54) SYSTEM AND METHOD FOR PRODUCING ULTRAFINE METAL PARTICLES SUSPENDED IN AQUEOUS MEDIUM

(75) Inventors: Robert H. Todd, Provo, UT (US); Christopher J. Lewis, Saratoga Springs, UT (US); Jonathan George, Lehi, UT (US)

(73) Assignee: Brigham Young University, Provo, UT (US)

( * ) Notice: Subject to any disclaimer, the term of this patent is extended or adjusted under 35 U.S.C. 154(b) by 511 days.

(21) Appl. No.: 12/706,905

(22) Filed: Feb. 17, 2010

(65) Prior Publication Data

US 2010/0206734 A1 Aug. 19, 2010

Related U.S. Application Data

(60) Provisional application No. 61/207,902, filed on Feb. 17, 2009.

(51) Int. Cl.
*B01J 19/08* (2006.01)
*B22F 9/04* (2006.01)

(52) U.S. Cl.
CPC ..... *B22F 9/04* (2013.01); *B22F 2998/00* (2013.01)
USPC ..... 422/186.16; 422/186; 422/186.03; 205/74; 204/242; 204/277; 204/164

(58) Field of Classification Search
CPC ..... B22F 9/04; B22F 9/14; B22F 2998/00; B01J 19/08; B01J 19/087
USPC ..... 204/164, 242, 277; 205/74; 422/186, 422/186.03, 186.16
See application file for complete search history.

(56) References Cited

U.S. PATENT DOCUMENTS

| | | | | |
|---|---|---|---|---|
| 4,508,950 | A * | 4/1985 | Inoue | 219/69.14 |
| 5,498,320 | A | 3/1996 | Rendall | |
| 2002/0014400 | A1 * | 2/2002 | Zadiraka et al. | 204/158.2 |
| 2007/0158196 | A1 | 7/2007 | Kang et al. | |

FOREIGN PATENT DOCUMENTS

| | | |
|---|---|---|
| JP | 11080987 | 3/1999 |
| KR | 20030078391 | 10/2003 |
| WO | WO02/43905 | 6/2002 |

OTHER PUBLICATIONS

Tien et al "Novel technique for preparing a nano-silve water suspension by the arc discharge method", Rev. Adv. Mater. Sci. 18 (2008), p. 750-756.*

(Continued)

*Primary Examiner* — Xiuyu Tai
(74) *Attorney, Agent, or Firm* — Thorpe North & Western LLP

(57) ABSTRACT

The present disclosure is drawn to methods and systems for producing solutions containing ultrafine metal particles. The method for producing ultrafine metal particles in an aqueous medium includes providing a reaction chamber having a transition metal anode and a transition metal cathode disposed therein. The reaction chamber can also contain an aqueous medium. An anode and cathode are associated at a distance with respect to one another such that when activated by a power source, a discharge arc occurs between the anode and cathode within the aqueous medium. Activation of a power source causes the discharge arc to occur between the anode and the cathode, thereby generating ultrafine metal particles suspended within the aqueous medium.

15 Claims, 3 Drawing Sheets

(56) References Cited

OTHER PUBLICATIONS

Chen et al "In-situ measurement and cotnrol of electric discharge on submerged arc synthesis process for continuous TiO2 naoparticle fabrication", Materials Transactions, vol. 60 No. 10 (2004) p. 3071-3078.*

Horvath et al. "A low-voltage spark generator for production of carbon particles". Journal of Aerosol Science 34 (2003). pp. 1581-1588.

Asit Kumar Khanra et al., Microanalysis of debris formed during electrical discharge machining (EDM). J Mater Sci (2007) 42:872-877.

N. Sano et al. "Immune defence in bumble-bee offspring" Nature vol. 414 Nov. 29, 2001. www.nature.com. pp. 506-507.

Vasudevamurthy et al., "Effect of system parameters on size distribution of 304 stainless steel particles produced by electrical discharge mechanism". Materials letters 61 (2007) 4872-4874.

H. Wang et al., "Large-scale synthesis of single-walled carbon nanohorns by submerged arc" Nanotechnology 15 (2004) 546-550.

Lilian P. Davila et al., "Microstructure and microchemistry of silicon particles formed during electrical-discharge machining". Journal of Materials Science: Materials in Electronics 14 (2003) 507-510.

E.D. Cabanillas. "TEM observations of particles obtained by electro-erosion in kersone". J Mater Sci (2007) 42:3155-3160.

A.E. Berkowitz et al., "Spark erosion: A method for producing rapidly quenched fine powders" J. Mater. Res. 2 (2), Mar./Apr. 1987. pp. 277-288.

A.E. Berkowitz et al., "Amorphous sof magnetic particles produced by spark erosion". Journal of Magnetism and Magnetic Materials 254-255 (2003) 1-6.

E.D. Cabanillas. "Production of uranium-molybdenum particles by spark-erosion" Journal of Nuclear Materials 324 (2004) 1-5.

* cited by examiner

SYSTEM AND METHOD FOR PRODUCING ULTRAFINE METAL PARTICLES SUSPENDED IN AQUEOUS MEDIUM

PRIORITY CLAIM

This application claims the benefit of U.S. Provisional Patent Application Ser. No. 61/207,902, filed Feb. 17, 2009, which is hereby incorporated by reference in its entirety.

BACKGROUND

Aqueous solutions containing metal particles, such as elemental metal and metal oxides, can be used in a wide range of applications in a variety of industries. As an example, one application is the use of aluminum oxide particles in a low pressure water jet for dental cutting applications. Unfortunately, in many industry applications, standard metal particles are too large for suspension in an aqueous solution and require constant agitation and/or the use of complicated technologies for their use. These challenges increase the cost of these industrial applications and frequently make them cost prohibitive. Smaller ultrafine particles that do not precipitate out of solution, e.g. colloidal metal solutions, could replace standard metal particles in many of these applications. However, production methods for such particles have typically yielded levels that are cost prohibitive. Accordingly, research continues into methods and systems for quickly and efficiently producing aqueous solutions with suspended ultrafine metal particles.

SUMMARY

The present disclosure is drawn to methods and systems for producing solutions containing ultrafine metal particles. Accordingly, in one embodiment of the disclosure, a method for producing ultrafine metal particles in an aqueous medium is provided. The method includes providing a reaction chamber having a transition metal anode and a transition metal cathode disposed therein. The reaction chamber also contains an aqueous medium. The anode and cathode are associated at a distance with respect to one another such that when activated by a power source, a discharge arc occurs between the anode and cathode within the aqueous medium. The method further included activating the power source to cause the discharge arc to occur between the anode and the cathode, thereby generating ultrafine metal particles suspended within the aqueous medium.

In another embodiment, a system for producing solutions containing ultrafine metal particles is provided. The system can include a reaction chamber configured to retain an aqueous medium, a pulsing power source configured to provide and control electric current, a transition metal cathode, a transition metal anode, and a control unit configured to monitor and adjust the discharge gap to maintain it within a predetermined range by moving at least one of the anode or the cathode. The transition metal anode and transition metal cathode are operably connected to the pulsing power source and configured to be submersed in an aqueous medium such that a discharge gap is present between the transition metal anode and transition metal cathode.

In yet a further embodiment, a system for producing solutions containing ultrafine metal particles is provided. The system can include a reaction chamber configured to retain an aqueous medium and an aqueous medium disposed within the reaction chamber, the aqueous medium being seeded with a predetermined amount of metallic particles. The system further includes a pulsing power source capable of controlling electric current, a transition metal cathode and transition metal anode, and an aqueous medium management system. The transition metal cathode and transition metal anode can be operably connected to the pulsing power source and are disposed in the aqueous medium such that a discharge gap is present between the transition metal anode and the transition metal cathode. The aqueous medium management system can be operably connected to the reaction chamber and configured to maintain the concentration of the metallic particles in the aqueous medium within a predetermined range.

Figure 1:
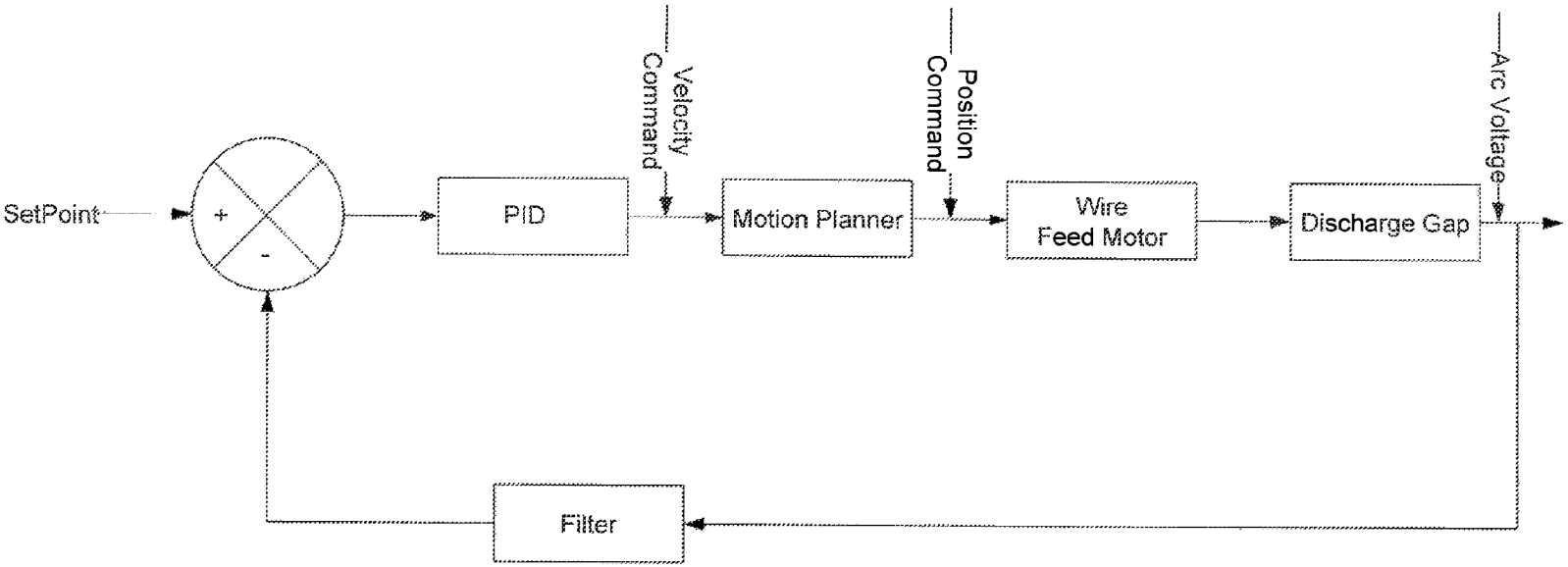
FIG. 1 is a block diagram of one embodiment of a control unit that can be used to monitor and adjust the discharge gap in the systems and methods of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Before the present systems and methods for producing solutions containing ultrafine metal particles are disclosed and described, it is to be understood that this invention is not limited to the particular process steps and materials disclosed herein, but is extended to equivalents thereof, as would be recognized by those ordinarily skilled in the relevant arts. It should also be understood that terminology employed herein is used for the purpose of describing particular embodiments only and is not intended to be limiting.

It should be noted that, the singular forms "a," "an," and, "the" include plural referents unless the context clearly dictates otherwise. Thus, for example, reference to "a transition metal" includes reference to one or more of such excipients, and reference to "the particle" includes reference to one or more of such reaction particles.

As used herein the term "transition metal" refers to elemental metals and their alloys found in columns IB and IIB, and the post-transition metals of Column IIIA of the periodic table as well as platinum, nickel, rhodium, iridium, and, palladium. Non-limiting examples of transition metal alloys that can be used as the anode or cathode in the systems and methods of the present disclosure include platinum, palladium, aluminum, silver, zinc, aluminum, cadmium, mercury, thallium, indium, gallium, copper, nickel, gold, rhodium, and iridium and alloys thereof.

As used herein, the term "submersed," when used to describe the position of the electrodes with respect to the aqueous medium, does not require that the entire electrode be submersed, but only a sufficient portion of the electrode such that a arc discharge can form between the two electrodes in the aqueous medium.

As used herein, the term "electrode," refers to the transition metal anode or the transition metal cathode either individually or collectively.

The term "ultrafine metal particles" refers to particles of elemental transition metals, transition metal oxides, alloys of transition metals, metal carbonates, metal sulfates, and mixtures thereof, having particle sizes of about 0.3 nm to about 4 μm particles and which can be suspended in an aqueous medium to form a solution (e.g. a colloidal solution). In one embodiment, the ultrafine metal particles can have a particle size of about 150 nm to about 3 μm. In another embodiment, the ultrafine particles can have a particle size of about 300 nm to about 3 μm.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, levels and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Reference will now be made in detail to certain embodiments of the present disclosure. While the disclosure will be described in conjunction with these embodiments, it will be understood that it is not intended to limit the disclosure to those embodiments. To the contrary, it is intended to cover alternatives, variants, modifications, and equivalents as may be included within the spirit and scope of the disclosure as defined by the appended claims.

In accordance with this, the present disclosure is drawn to systems and methods for producing aqueous solutions with ultrafine metal particles suspended therein. It is noted that when discussing the present systems and associated methods, each of these discussions can be considered applicable to each of these embodiments, whether or not they are explicitly discussed in the context of that embodiment. Thus, for example, in discussing a power source for use in a system of the present disclosure, such a power source can also be used in the methods of the disclosure, and vice versa.

In one embodiment of the disclosure, a method for producing ultrafine metal particles in an aqueous medium is provided. The method includes providing a reaction chamber having a transition metal anode and a transition metal cathode disposed therein. The reaction chamber also contains an aqueous medium. An anode and cathode are associated at a distance with respect to one another such that when activated by a power source, a discharge arc occurs between the anode and cathode within the aqueous medium. Thus, activation of a power source causes the discharge arc to occur between the anode and the cathode, thereby generating ultrafine metal particles suspended within the aqueous medium.

In another embodiment, a system for producing solutions containing ultrafine metal particles is provided. The system can include a reaction chamber configured to retain an aqueous medium, a pulsing power source capable of controlling electric current, a transition metal cathode and a transition metal anode and a control unit configured to monitor and adjust the discharge gap to maintain it within a predetermined range by moving at least one of the anode or the cathode. The transition metal anode and transition metal cathode are operably connected to the pulsing power source and configured to be submersed in an aqueous medium such that a discharge gap is present between the anode and cathode.

In yet another embodiment, a system for producing solutions containing ultrafine metal particles is provided. The system can include a reaction chamber configured to retain an aqueous medium and an aqueous medium disposed within the reaction chamber, that aqueous medium being seeded with a predetermined amount of metallic particles. The system further includes a pulsing power source capable of controlling electric current, a transition metal cathode and transition metal anode, and an aqueous medium management system. The transition metal cathode and transition metal anode can be operably connected to the pulsing power source and are disposed in the aqueous medium such that a discharge gap is present between the transition metal anode and the transition metal cathode. The aqueous medium management system can be operably connected to the reaction chamber and configured to maintain the concentration of the metallic particles in the aqueous medium within a predetermined range.

The power sources of the systems and methods of the present disclosure can be of a wide range of complexities and performance characteristics. Both alternate current (AC) or direct current (DC) power sources can be used. In one aspect of the disclosure, the power source can be a direct current power source. Direct current power sources have the property that the cathode and anode do not reverse roles, thus the erosion of the respective electrodes can be better controlled and accounted for, i.e. erosion as the metal particles fall from the electrode(s) due to the discharge arc. One example of an off-the-shelf DC power source that can be used is a Miller XMT 350 MPA Multi-Process DC power source. Alternatively, one might use an AC current in some circumstances, which can provide for more equal wear of the cathodes. An example of an AC source that may be suitable is Miller XMT 350 MPA Multi-Process AC power source.

In another aspect of the invention, the power source can be a pulsing power source. A pulsing power source provides pulses of current to the electrodes at selected intervals. It has been discovered that pulsing power sources increase the productivity and efficiency of the systems and methods of the present disclosure. Specifically, benefits associated with the use of pulsing power sources can include reduced cathode wear (such as when the power source is a DC power source), enhanced electrical efficiency, enhanced control over particle size, increased generation rate of suspended particles in the aqueous medium, lower average electrode temperatures, and reduction in the formation of undesirable large particles.

The power sources for use in the systems and methods of the present disclosure can provide voltages of from about 10 V to about 300 V. In one aspect of the invention, the power source can be configured to provide a voltage of from about 20 V to about 150 V. In another embodiment, the power source can be configured to provide a voltage of from about 70 V to about 120 V. In another embodiment, the power source can be configured to provide a voltage of from about 80 V to about 110 V. The power sources of the present disclosure can further be configured to provide current levels of 10 amps to about 75 amps. In one embodiment, the power source can be configured to provide current levels of about 16 amps to about 65 amps.

As discussed above, the pulsing power supplies can provide enhanced productivity and efficiency as compared to non-pulsed supplies. With respect to the benefit of enhanced control of particle size, it has been discovered that adjustments in the frequency, and in particular, adjustments in the pulse width, can be used to control the size the metal particles generated. Specifically, it has been discovered that as the pulse width decreases, the particle size can be decreased. Thus, the ability to control the particle size using pulse frequency and pulse width is surprising.

In contrast, it has also been discovered that the change in current, independent of the pulse width and frequency, does not substantially affect the particle size. However, it has also been discovered that particle quantity is a function of current flow across the discharge gap. As a generalization, the larger levels of current that passes across the discharge gap, the greater the rate of particle production. Thus, while the pulse width may be used to target a particular particle size range, current levels can be adjusted to adjust particle production rates.

In light of this, the pulsing power sources used in the systems and methods of the present disclosure can be configured to provide a range of pulse frequencies, pulse widths, and duty cycles. In one embodiment, the pulsing power source can provide a pulse frequency of about 2 kHz to about 30 kHz. In another embodiment, the pulsing power source can provide a pulse frequency of about 5 kHz to about 25 kHz. In yet a further embodiment, the pulsing power source can provide a pulse frequency of about 10 kHz to about 20 kHz. The duty cycle for the pulsing power source can be from about 20% to about 80%. In one embodiment, the duty cycle can be from about 30% to about 70%. Further, the pulsing power sources of the present disclosure can provide a pulse width of about 0.014 ms to about 0.14 ms. In one embodiment, the pulsing power source can provide a pulse width of about 0.014 ms to about 0.04 ms.

The reaction chambers of the present disclosure can be enclosed or open vessels, so long as they are capable of retaining an aqueous medium in which an arc discharge may occur. The shape, size, and other characteristics of the reaction chamber may be varied, depending on the amount of aqueous medium the reaction chamber is intended to hold and on the number of anode and cathode pairs that are intended to be submersed in the aqueous medium. In one embodiment, the reaction chamber can be an enclosed or partially enclosed cylinder into which the anode and cathode can protrude. In another embodiment, the reaction chamber can be in the form of an open-air container into which the transition metal anode and transition metal cathode can be placed. Circulation plumbing or other systems can be utilized to provide recirculating flow of the aqueous medium to the gap between the anode and cathode. Thus, for example, an otherwise enclosed reaction chamber may include an outlet port and an inlet port, and a pump/tubing therebetween to cause flow out of the reaction chamber at one location and returning into the reaction chamber at another location.

Regardless of the configuration of the reaction chamber, the systems and methods of the present disclosure can also include an aqueous medium management system. The aqueous vehicle management systems of the present disclosure can be operably connected to the reaction chamber and configured to maintain the concentration of the metallic particles in the aqueous medium within a predetermined range. The aqueous medium management system can include one or more of the following components: an aqueous medium reservoir(s), a cooler(s) for cooling the aqueous medium to a desired temperature, a pump(s) for circulating the aqueous medium throughout the reaction chamber and the components of the aqueous medium management system, and/or metal particle concentration feedback detector unit(s) configured to monitor the concentration of the metal particles and add and remove aqueous medium in order to maintain the concentration within a predetermined range. The aqueous medium management system can also include other components such as flow rate monitors, conductivity measurement devices, particle concentration detectors, turbidity detectors, tubing, valves, seals, filters, and the like, in order to facilitate the circulation of the aqueous medium throughout the system. Other components may also be used in the aqueous medium management system in order to provide additional process control.

The aqueous medium used in the systems and methods of the present disclosure can be purified deionized water produced by any technique known in the art. The aqueous medium can also be infused with a gas, such as carbon dioxide (i.e. carbonated) in some embodiments. In one aspect of the disclosure, the aqueous medium can be seeded with metal particulates prior to the activation of the power source. In another embodiment, the device can be used to slowly seed purified water, and then once the concentration has achieved a predetermined target level, that target level can be sustained within an acceptable range using the aqueous medium management system. The seeding particulates can have the same or unique compositional makeup compared to the particles produced by the activation of the power source. It has been discovered that the rate of production of the ultrafine metal particulates can be accelerated by seeding the aqueous medium prior to operation.

In one embodiment, the aqueous medium can be seeded with the same metal particles targeted for generation. When seeding is done, the particles can be seeded at a predetermined concentration, such as a concentration that is less than or equal to the target concentration for the aqueous medium. Target concentrations for the ultrafine metal particles of the solutions produced by the system and methods of the present disclosure can range from 200 ppm to 2000 ppm. In one embodiment, target concentration can be about 300 ppm to about 1000 ppm.

The systems and methods of the present disclosure can produce particles across a wide particle size range. However, particles that are excessively large typically do not stay in solution and can be undesirable in some applications. In one embodiment, particles produced by the systems and methods of the present disclosure can have a particle size of about 0.3 nm to about 4 μm. In another embodiment, the systems and methods can be configured to produce particles having sizes of about 150 nm to about 3 μm. In another embodiment, the particle size can be from about 300 nm to about 3 μm.

The transition metal electrodes (anodes and cathodes) of the present disclosure can be made of the same metal as each other or they can be compositionally different. In one embodiment, the transition metal anode and transition metal cathode can be made from a metal selected from the group consisting of platinum, palladium, aluminum, silver, zinc, aluminum, cadmium, mercury, thallium, indium, gallium, copper, nickel, gold, rhodium, and iridium and alloys thereof. The geometries of the transition metal electrodes can be varied and modified in order to be compatible with the other components of the system. In one embodiment, one or both of the transition metal electrodes can be a rod of any cross-sectional profile, e.g., cylindrical or semi-cylindrical cross-section having a diameter of about 0.5 inch to about 1.5 inches. In another embodiment, at least one of the transition metal electrodes can be a wire having a diameter of less than 0.5 inches. In another embodiment, at least one of the transition metal electrodes can be a plate. It is noteworthy that the transition metal anode and the transition metal cathode do not need to have the same geometry. For example, in one embodiment, the transition metal anode can be a wire having a diameter of less than about 0.5 inches and the transition metal cathode can be a rod or a plate. Other functional combination can also be used.

Depending on the geometry of the electrodes, efficiency and productivity of the system can be improved by resurfacing and/or reshaping the faces of the electrodes in order to make them more uniform. Resurfacing of the electrodes can be done using any technique known in the art. In order to reduce the need to resurface the faces of the electrodes, the system can also include a mechanism for rotating the electrodes within the system. The rotation of the electrodes can increase the uniformity of the electrode erosion thereby reducing the need to resurface.

Regardless of the geometry of the transition metal electrodes, the electrodes are disposed within the system such that, when aqueous medium is present in the reaction chamber, the electrodes can be operably connected to the power source submersed in the aqueous medium such that a discharge gap is present between the transition metal anode and the transition metal cathode. In one embodiment, the discharge gap can have a distance of about 0.0001 inches to about 0.005 inches. In another embodiment, the discharge gap can be 0.0005 inches to about 0.002 inches.

A control unit can be associated with the other components of the system in order to monitor and adjust the length of the discharge gap in order to maintain the gap within a predetermined range. The control unit can use adaptive algorithms to monitor and adjust the discharge gap. In one embodiment, the control unit can be similar to the one shown in FIG. 1. A control unit, such as the unit shown in FIG. 1, works by generating an error signal by subtracting the current discharge gap voltage from an arc voltage setpoint. The arc voltage is an estimate of the discharge gap distance and the setpoint voltage represents an acceptable electrode gap distance to stabilize the discharges. The arc voltage signal can be filtered with analog and digital filters to produce an average arc voltage over several milliseconds. The error signal can than be used as the input for the control unit. The command signal generated by the control unit can be interpreted as a velocity command for the electrode. A stepper motor can be used to adjust the electrode, such as adjustment of the anode. Other motors such as server motors, solenoids, and other mechanical systems can be used to provide electrode movement. In one aspect, it can be beneficial to pass the velocity command from the control unit through a motion planer algorithm to limit the acceleration and reduce the amount of "jerk" that occurs with the electrode adjustment.

In one embodiment of the systems and methods of the present disclosure, a gas discharge component can be used to flow gas across the discharge gap. Any type of injector or gas discharge component known in the art can be used. Non-limiting examples of such components that can be used to flow the gas across the discharge gap include venturi gas injectors and buddle diffusers. The flowing of the gas across the discharge gap can reduce or eliminate the buildup of particles on the electrode surfaces. Further, the gas can be used to alter the compositional nature of the particulates formed by the process. For example, when the transition metal anode is aluminum, oxygen could be used as the flow gas in order to increase the yield of aluminum oxide particulates in the solution. Non-limiting examples of gases that can be used in the systems and methods of the present disclosure include carbon dioxide, oxygen, ozone, argon, neon, krypton, xenon, hydrogen, sulfur dioxide, nitric oxide, ammonia, chlorine, fluorine, bromine, and iodine, and mixtures thereof. With this in mind, the systems and methods of the present disclosure can be used to generate a variety of metal particle types in aqueous solutions. In one embodiment, the metal particles generated by the systems and methods of the present disclosure can be metal oxides, elemental metals or metal alloys with little to no oxidation (<5%), metal carbonates, metal sulfates, and mixtures thereof.

EXAMPLES

The following examples are provided to promote a more clear understanding of certain embodiments of the present invention, and are in no way meant as a limitation thereon.

Example 1

Figure 2:
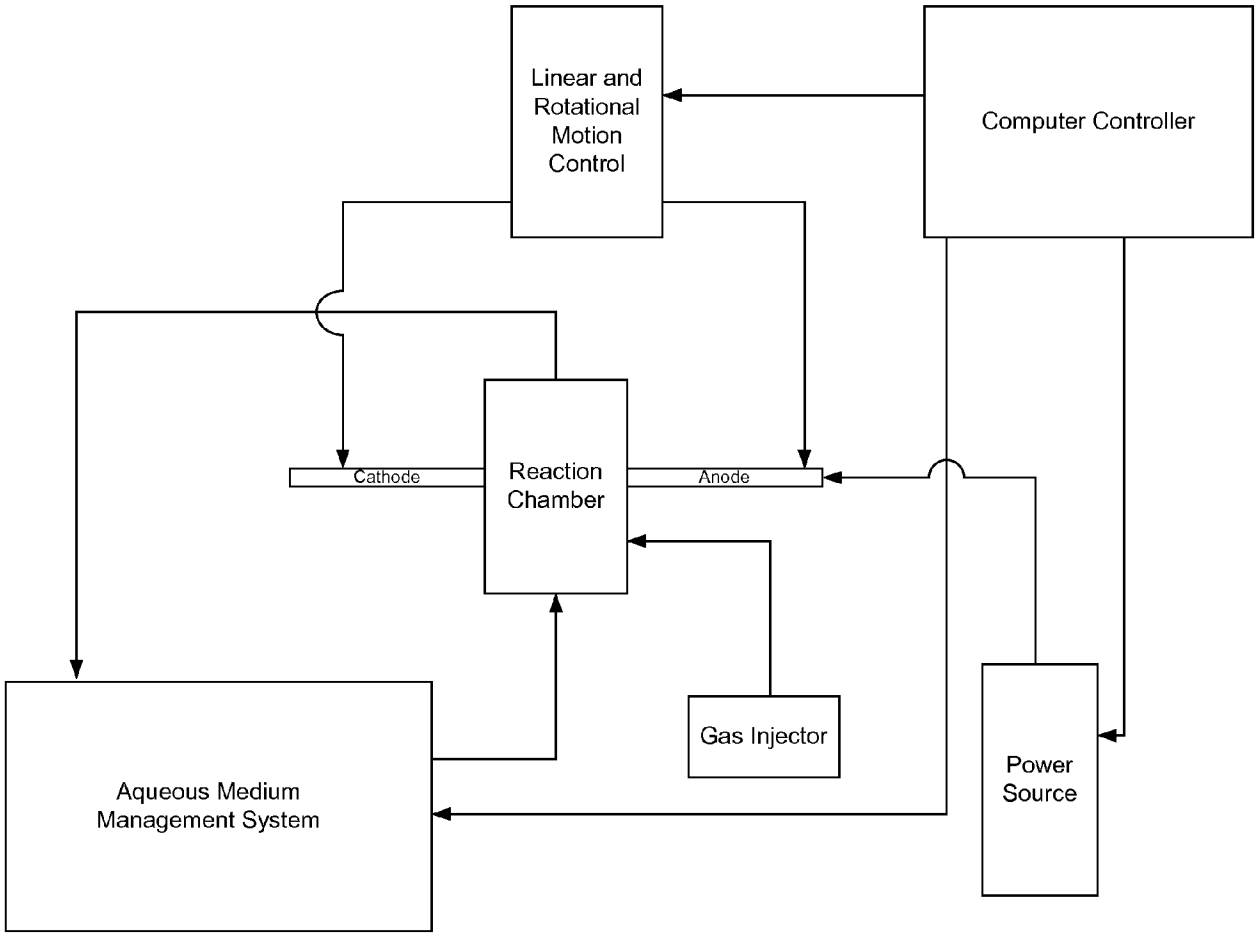
FIG. 2 is a block diagram of one embodiment of a system of the present invention.

System for Making Solutions Containing Suspended Ultrafine Metal Particle using Rod Electrodes A system for making solutions containing ultrafine metal particles was prepared as set forth below. FIG. 2 shows a block diagram showing the general configuration of the system, though this diagram is schematic and should not be considered limiting. The system included a computer controller/operator interface, a reactor chamber, a rotational and linear motion control system, an aqueous medium management system, a power source, and associated mechanical support structures, as shown in the arrangement of FIG. 2.

The computer controller was a Dell Desktop running windows XP and the operator interface was a custom executable filed developed with National Instruments Labview® software. The Labview® software was not required to run the file, but was used for development of the program.

Figure 3:
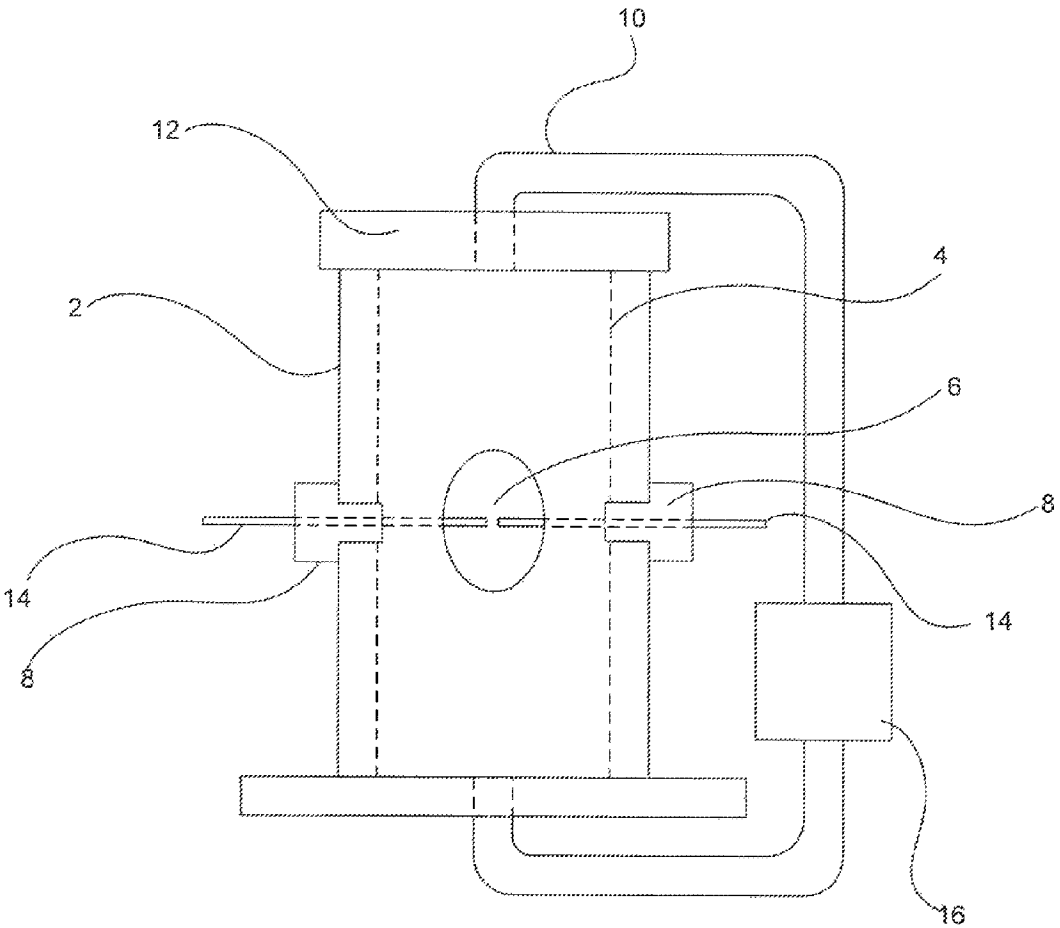
FIG. 3 is a side view of one embodiment of a reaction chamber that can be used in the systems of the present invention.

The reactor chamber was developed using an inline arc discharge concept which allowed for a relatively small footprint for the system as a whole, which is shown in FIG. 3. The chamber included a cylindrical body 2 made of a polyester, an inner sleeve 4 of Teflon® that fits inside the cylindrical body, a viewing window assembly 6 including a quartz glass viewing window that attenuates some of the ultra-violate radiation, and an electrode seal assembly 8 for each electrode 14. The electrode seal assembly can include various seals, bearings, housings (not shown), etc., such as a wiper seal, Teflon® bearing, or housing structure. The assembly was designed to be removable so that if there is wear on the electrode, the electrode can be removed without the need to disassemble the entire assembly. The reactor chamber is capped by a mounting plate 12 configured to receive a hose fitting 10 that is connected to a reservoir and pump 16 which circulate the aqueous medium. While this is one possible structure, other structures can be used.

The rotational and linear motion control system monitors and controls the distance of the discharge gap as well as the rotation of the electrodes. The linear motion component of the motion control assembly was controlled using an IGUS linear slide with micro-stepping motors to actuate the linear and rotational motion via drive belts and pulleys. The rotational and linear motion control system attaches directly to the electrode.

The system aqueous medium management system included a 5 gallon tank, a chiller capable of maintaining the aqueous medium at a temperature of about 40° F. to about 120° F., a recirculation pump, tubing, fittings and valves which connected the components to each other and to the reaction chamber.

The power source used for generating the generating the arc discharge was a Millar XMT 350 MPA power source. The power source was connected to the electrode as well as to the computer controller Example 2

System for Making Solutions Containing Suspended Ultrafine Metal Particle using a Wire Anode and a Pulsing Power Source A system having an open-top reaction chamber was prepared. Wire electrodes enter the top of the reactor and are guided by a Teflon® tube that is formed into a curve. As the wires are fed through the Teflon® tubes they are bent into a circular arc until the wires are horizontal and with their tips opposite one another. Because the electrode enters from the top of the reactor chamber, no seals are required. It is noteworthy that the system can be configured to replace one of the wire electrodes, e.g. the cathode, with a larger diameter wire, rod, or plate, for example.

The aqueous medium enters the reactor through a tube that flushes over the discharge gap and fills the reactor. When the reaction chamber is full of the aqueous medium, the discharge gap is below the surface of the aqueous medium. The reaction chamber also includes an overflow pipe through which the aqueous medium exits. The overflow pipe is connected to a 10 gallon storage tank. The aqueous medium that enters the reaction chamber is drawn from the same 10 gallon storage tank. Thus, the aqueous medium management system is a closed loop system. The aqueous medium can be recirculated until the concentration of the particles in the aqueous medium is at the desired level. When the particle concentration reactions the desired concentration, a peristaltic pump can remove the fluid from the storage tank and a float valve in the storage tank triggers the addition of RODI water to maintain the aqueous medium volume at a desired level.

As the wire anode is eroded, a control unit monitors and adjusts the discharge gap to maintain it within a predetermined range. The control unit includes a friction drive roller made from U-Groove drive wheels from a Miller wire feed welder. The diameter of the drive rollers is about 1.6 inches. Because the discharge gap is small, high resolution position of the electrodes is achieved using a micro-stepping stepper motor along with a 10:1 gearbox. The stepper motor is driven with a 256 micro stepping controller that results in a theoretical 102,400 steps per revolution. The drive roller is electrically isolated from the stepper motor using a Kevlar® bands which transmit the torque from the gearbox to the drive roller. The control unit is believed to provide very high resolution of the wire positioning system.

The power source for the system is a simply current limiting pulsed DC power source. The power source design uses a resistor to limit the current across the discharge gap. The resistor is a passive element, so no active feedback loop is needed to provide constant current. A current range of 16 to 64 amps of peak current was selected and an open circuit voltage of 80 VDC was used to produce this current. The power source design requires an electronic switch to handle the high frequency switching load. A set of N-channel MOSFET transistors were selected for the source due to their low cost, high switching speed, and low resistance. A MOSFET gate drive was also selected to improve the switching characteristic and reduce the switching losses of the transistors.

In order to supply the appropriate voltage for a particular embodiment, a custom made toroidal transformer was used to convert three phase 208 VAC power to three phase 55 VAC power. A three phase full bridge rectifier was then used to rectify the power into a DC voltage. An LC input filter was used to filter the rectified DC voltage to a nearly constant voltage of 80 VDC.

The system further includes a computer control that acts to control both the power source and the motion control unit. The power source is controlled using an 8-bit micro controller connected to the power source, and the motion control unit is controlled on a PC running a real-time Linux operating system. The computer control unit uses software timers to turn the power source transistors on and off at the specified times. In addition, the computer control unit detects when the discharge stage has started. The start of the discharge stage is detected by the fall of the electrode gap voltage below 40 volts. A comparator is used to compare the electrode gap voltage to a reference of 40 volts. When the electrode gap voltage falls below 40 volts the computer control unit senses the output from the comparator and the timer is reset and starts counting. Once the timer reaches the specified time, the transistors are turned off and the current across the electrode gap is stopped. The counter is reset again and starts counting until the timer reaches the second specified time at which point the transistors are turned on again and the computer control unit waits for the discharge to start again.

The computer control unit controls the motion control unit through the open source Linux based CNC software suite called Enhanced Machine Controller, or EMC. This suite of software uses a robust real-time Linux operating system to close feedback loops in the operating system. Two PCI interface cards were used to connect the computer control unit to the motion control unit. A FPGA based motion control card was used to provide I/O and to output the step direction signals to the stepper motor controller. The second interface card provides several analog to digital converters. The voltage and current signals are acquired using the analog to digital PCI card and processed by the computer control unit, which in turn calculates a new position for the motor to move the wire, and thus, modifies the discharge gap distance. The feedback mechanism used with this system is previously and outlined schematically in FIG. 1.

Example 3

Metal Particle Production in Aqueous Solutions using Various Parameters

Twenty metal particle containing aqueous solutions were prepared as set forth below. A system similar to that of Example 2 was used to prepare the solutions. The cathode and anode were created from 99.9% pure copper. The cathode electrode was a flat plate, and the anode is a 1/16" wire electrode. The wire electrode was fed toward the cathode plate in a direction normal to the plate. Prior to each run, the machine was cleaned and all particles from previous runs were removed. Also, the electrodes were dressed to remove any burrs or material build-up prior to each run. After preparation of the electrodes, the electrodes were submerged in reverse osmosis/deionized water. The experiments were performed in a tub with no agitation or recirculation of the water, though recirculation of fluids can be advantageous in some embodiments. The power source settings were set to the values shown in Table I below and the system was run for a period sufficient to erode 5 cm (0.887 grams) of the anode. The time was recorded and the rate of erosion was calculated and recorded. The fluid in the tub was then mixed well to ensure even dispersal of the particles and 1 liter of the fluid was collected in a container for particle analysis.

Particle size analysis was performed using a Beckmann Coulter LS 230 laser diffraction particle analyzer. The instrument has a measurement range from 0.04-2000 um. The machine has an extended range PIDS (Polarization Intensity Differential Scattering) module allows the instrument to properly characterize particles in the 40-800 nm range that are typically difficult to measure with laser diffraction methods because the particles are smaller than the wavelength of the laser used (780 nm). The LS 230 use was fitted with a small volume fluid module that requires only a 200 ml fluid sample. 200 ml of RODI was placed in the LS 230 sample module and the machine was then calibrated and prepared to measure the sample. The container with the sample to be measured was shaken to disperse the large particles in the sample and then a syringe was used to introduce fluid from the sample container into the LS 230 sample module until the appropriate PIDS concentration was reached. A de-bubbling cycle was then run on the instrument to remove any air bubbles introduced in the sample chamber when the particles were introduced. The sample was analyzed in three 90 second runs. The three runs were then averaged to produce the single set of data seen in the PDF report. Data associated with the measurements is set forth in Tables I and II.

TABLE I

| Sample No. | Pattern | Current (amps) | Frequency (kHz) | Duty Cycle (%) | Ton (ms) | Toff (ms) |
|---|---|---|---|---|---|---|
| 1 | −−+ | 32 | 5 | 70 | 0.14 | 0.06 |
| 2 | −−− | 32 | 5 | 30 | 0.06 | 0.14 |
| 3 | A00 | 64 | 12.5 | 50 | 0.04 | 0.04 |
| 4 | 0A0 | 48 | 20 | 50 | 0.025 | 0.025 |
| 5 | +−− | 64 | 5 | 30 | 0.06 | 0.14 |
| 6 | a00 | 32 | 12.5 | 50 | 0.04 | 0.04 |
| 7 | ++− | 64 | 20 | 30 | 0.015 | 0.035 |
| 8 | 0a0 | 48 | 5 | 50 | 0.1 | 0.1 |
| 9 | 0 | 48 | 12.5 | 50 | 0.04 | 0.04 |
| 10 | 00a | 48 | 12.5 | 30 | 0.024 | 0.056 |
| 11 | 0 | 48 | 12.5 | 50 | 0.04 | 0.04 |
| 12 | 0 | 48 | 12.5 | 50 | 0.04 | 0.04 |
| 13 | 00A | 48 | 12.5 | 70 | 0.056 | 0.024 |
| 14 | −++ | 32 | 20 | 70 | 0.035 | 0.015 |
| 15 | +−+ | 64 | 5 | 70 | 0.14 | 0.06 |
| 16 | 0 | 48 | 12.5 | 50 | 0.04 | 0.04 |
| 17 | −+− | 32 | 20 | 30 | 0.015 | 0.035 |
| 18 | 0 | 48 | 12.5 | 50 | 0.04 | 0.04 |
| 19 | +++ | 64 | 20 | 70 | 0.035 | 0.015 |
| 20 | 0 | 48 | 12.5 | 50 | 0.04 | 0.04 |

TABLE II

| Sample No. | Volume % Mean Diameter (μm) | Volume % Standard Deviation (μm) | Number % Mean Diameter (μm) | Number % Standard Deviation (μm) | Rate Of Erosion (g/hr) |
|---|---|---|---|---|---|
| 1 | 11.63 | 13 | 0.471 | 0.36 | 4.5 |
| 2 | 7.51 | 8.468 | 0.529 | 0.368 | 4.8 |
| 3 | 7.111 | 7.345 | 0.213 | 0.277 | 7.69 |
| 4 | 1.284 | 1.013 | 0.137 | 0.128 | 5.65 |
| 5 | 7.241 | 7.786 | 0.571 | 0.433 | 7.6 |
| 6 | 1.25 | 0.977 | 0.114 | 0.096 | 4.44 |
| 7 | 0.988 | 0.706 | 0.33 | 0.161 | 3.26 |
| 8 | 4.275 | 5.726 | 0.471 | 0.309 | 7.09 |
| 9 | 6.844 | 9.161 | 0.458 | 0.338 | 6.37 |

TABLE II-continued

| Sample No. | Volume % Mean Diameter (μm) | Volume % Standard Deviation (μm) | Number % Mean Diameter (μm) | Number % Standard Deviation (μm) | Rate Of Erosion (g/hr) |
|---|---|---|---|---|---|
| 10 | 5.168 | 7.855 | 0.174 | 0.163 | 4.86 |
| 11 | 7.167 | 9.205 | 0.653 | 0.535 | 6.22 |
| 12 | 6.235 | 7.562 | 0.199 | 0.219 | 6.34 |
| 13 | 6.876 | 7.61 | 0.639 | 0.439 | 6.43 |
| 14 | 1.968 | 1.8 | 0.112 | 0.093 | 4.3 |
| 15 | 10.5 | 12.56 | 0.352 | 0.272 | 3.52 |
| 16 | 4.3 | 6.215 | 0.113 | 0.102 | 6.23 |
| 17 | 10.64 | 10.99 | 0.253 | 0.2 | 1.77 |
| 18 | 4.641 | 6.32 | 0.289 | 0.253 | 6.07 |
| 19 | 5.821 | 7.206 | 0.126 | 0.124 | 5.33 |
| 20 | 3.891 | 4.717 | 0.137 | 0.141 | 6.31 |

It has to be understood that the above-described examples and experiments are only illustrative of preferred embodiments and aspects of the present disclosure. Numerous modifications and alternative arrangements may be devised by those skilled in the art without departing from the spirit and scope of the present disclosure, and the appended claims are intended to cover such modifications and arrangements. Thus, while the present disclosure has been provided with particularity and detail in connection with what is presently deemed to be the most practical embodiments of the disclosure, it will be apparent to those of ordinary skill in the art that variations including, but not limited to, variations in size, materials, shape, form, function and manner of operation, assembly, use, etc., may be made without departing from the principles and concepts set forth herein.

What is claimed is:

1. A system for producing solutions containing ultrafine metal particles, comprising:

a reaction chamber configured to retain an aqueous medium;

a pulsing power source capable of controlling electric current;

a transition metal cathode and a transition metal anode operably connected to the pulsing power source and configured to be submersed in the aqueous medium, when present, such that a discharge gap is present between the transition metal anode and transition metal cathode;

a control unit configured to monitor and adjust the discharge gap to maintain the discharge gap within a predetermined range of about 0.0001 inches to about 0.005 inches by moving at least one of the anode or the cathode; and an aqueous medium management system operably connected to the reaction chamber and configured to maintain the concentration of the metallic particles in the aqueous medium within a predetermined range.

2. The system of claim 1, wherein the pulsing power source is a direct current power source.

3. The system of claim 1, wherein the pulsing power source is configured to provide a frequency of about 2 kHz to about 30 kHz.

4. The system of claim 1, wherein the pulsing power source is configured to provide a frequency of about 5 kHz to about 25 kHz.

5. The system of claim 1, wherein the pulsing power source is configured to provide a frequency of about 10 kHz to about 20 kHz.

6. The system of claim 1, wherein the pulsing power source is configured to provide a pulse width of about 0.014 ms to about 0.14 ms.

7. The system of claim 1, wherein the pulsing power source is configured to provide a pulse width of about 0.014 ms to about 0.04 ms.

8. The system of claim 1, wherein the pulsing power source is configured to provide a current of about 10 amps to about 75 amps.

9. The system of claim 1, wherein the pulsing power source is configured to provide a current of about 16 amps to about 65 amps.

10. The system of claim 1, wherein the transition metal anode and transition metal cathode are comprised of a metal selected from the group consisting of platinum, palladium, aluminum, silver, zinc, aluminum, cadmium, mercury, thallium, indium, gallium, copper, nickel, gold, rhodium, and iridium and alloys thereof.

11. The system of claim 1, wherein the transition metal anode and the transition metal cathode are comprised of a metal selected from the group consisting of copper, aluminum, and silver.

12. The system of claim 1, wherein the system further includes a gas injector configured to flow gas across the discharge gap.

13. The system of claim 12, wherein the gas selected from the group consisting of carbon dioxide, oxygen, ozone, argon, neon, krypton, xenon, hydrogen, sulfur dioxide, nitric oxide, ammonia, chlorine, fluorine, bromine, and iodine, and mixtures thereof.

14. The system of claim 1, wherein the transition metal anode is a wire.

15. The system of claim 1, wherein the system is configured to recirculate the aqueous medium within or through the reaction chamber such that there is recirculating fluid flow at the discharge gap.

* * * * *